US005630479A

United States Patent [19]

Dennis

[11] Patent Number: 5,630,479

[45] Date of Patent: May 20, 1997

[54] CUTTING ELEMENT FOR DRILL BITS

[76] Inventor: Mahlon D. Dennis, 3726 Rocky Woods, Kingswood, Tex. 77339

[21] Appl. No.: 577,899

[22] Filed: Dec. 22, 1995

Related U.S. Application Data

[60] Division of Ser. No. 323,898, Oct. 17, 1994, Pat. No. 5,544,713, which is a continuation-in-part of Ser. No. 108, 071, Aug. 17, 1993, Pat. No. 5,379,854.

[51] Int. Cl.[6] ..... E21B 10/58

[52] U.S. Cl. ..... 175/426; 51/295; 175/434; 76/108.4; 408/145

[58] Field of Search ..... 175/426, 374, 175/420.1, 434; 51/295, 307; 407/118, 119; 408/144, 145; 76/108.2, 108.4

[56] References Cited

U.S. PATENT DOCUMENTS 3,599,737 8/1971 Fischer ..... 175/426 X 4,108,260 8/1978 Bozarth ..... 175/426 X 4,150,728 4/1979 Garner et al. ..... 175/426 X 4,694,918 9/1987 Hall ..... 175/430

*Primary Examiner*—Stephen J. Novosad

*Attorney, Agent, or Firm*—Gunn & Associates, P. C.

[57] ABSTRACT

A cutting element which has a metal carbide stud having a conic tip formed with a reduced diameter hemispherical outer tip end portion of said metal carbide stud. A layer of polycrystalline material, resistant to corrosive and abrasive materials, is disposed over the outer end portion of the metal carbide stud to form a cap. An alternate conic form has a flat tip face. A chisel insert has a transecting edge and opposing flat faces. It is also covered with a PDC layer.

4 Claims, 1 Drawing Sheet

FIG. 2
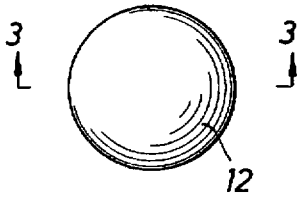
FIG. 1
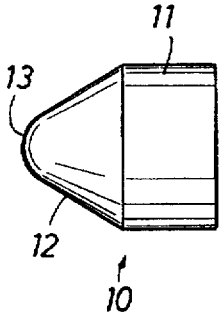
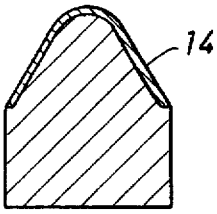
FIG. 3
FIG. 5
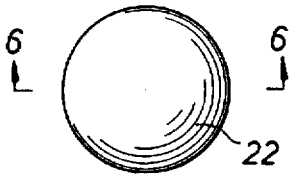
FIG. 4
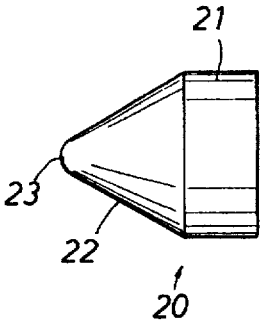
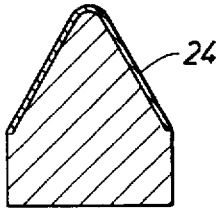
FIG. 6
FIG. 8
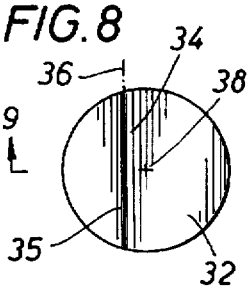
FIG. 7
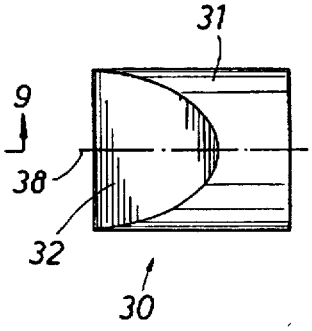
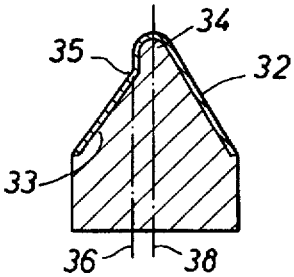
FIG. 9
FIG. 11
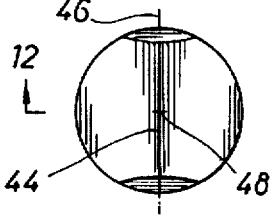
FIG. 10
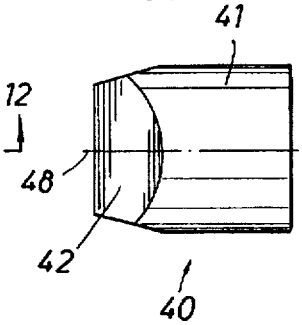
FIG. 14
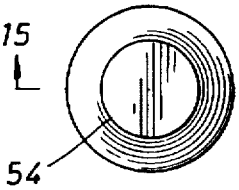
FIG. 13
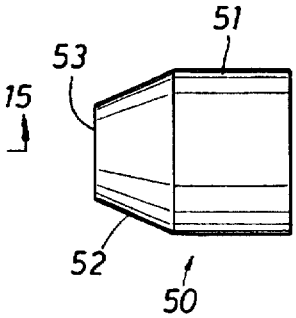
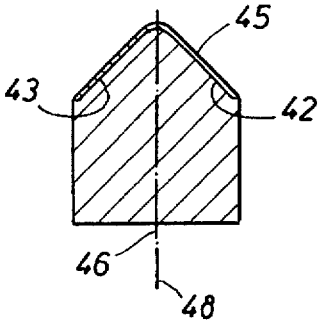
FIG. 12
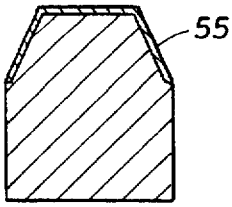
FIG. 15

CUTTING ELEMENT FOR DRILL BITS

This is a Divisional of U.S. patent application Ser. No. 08/323,898 filed on Oct. 17, 1994, now U.S. Pat. No. 5,544,713, which is a continuation-in-part application of U.S. patent application Ser. No. 08/108,071 filed on Aug. 17, 1993 and issued as U.S. Pat. No. 5,379,854.

BACKGROUND OF THE INVENTION

The present invention relates to the fabrication of cutting elements for use in rock drilling, machining of wear resistant metals, and other operations which require the high abrasion resistance or wear resistance of a diamond surface. Specifically, this invention relates to such bodies which comprise a polycrystalline diamond layer attached to a cemented metal carbide stud through processing at ultrahigh pressures and temperatures.

In the following disclosure and claims, it should be understood that the term polycrystalline diamond, PDC, or sintered diamond, as the material is often referred to in the literature, can also be any of the superhard abrasive materials, including, but not limited to synthetic or natural diamond, cubic boron nitride, and wurtzite boron nitride as well as combinations thereof. Also, cemented metal carbide refers to a carbide of one of the group IVB, VB, or VIB metals which is pressed and sintered in the presence of a binder of cobalt, nickel, or iron and the alloys thereof.

This application is related to composite or adherent multimaterial bodies of diamond, cubic boron nitride (CBN) or wurtzite boron nitride (WBN) or mixtures thereof for use as a shaping, extruding, cutting, abrading or abrasion resistant material and particularly as a cutting element for rock drilling.

As discussed in U.S. Pat. No. 4,255,165, a cluster compact is defined as a cluster of abrasive particles bonded together either (1) in a self-bonded relationship, (2) by means of a bonding medium disposed between the crystals, or (3) by means of some combination of (1) and (2). Reference can be made to U.S. Pat. Nos. 3,136,615; 3,233,988 and 3,609,818 for a detailed disclosure of certain types of compacts and methods for making such compacts. The disclosures of these patents are hereby incorporated by reference herein.

A composite compact is defined as a cluster compact bonded to a substrate material such as cemented tungsten carbide. A bond to the substrate can be formed either during or subsequent to the formation of the cluster compact. It is, however, highly preferable to form the bond at high temperatures and high pressures comparable to those at which the cluster compact is formed. Reference can be made to U.S. Pat. Nos. 3,743,489; 3,745,623 and 3,767,371 for a detailed disclosure of certain types of composite compacts and methods for making same. The disclosures of these patents are hereby incorporated by reference herein.

As discussed in U.S. Pat. No. 5,011,515, composite polycrystalline diamond compacts, PDC, have been used for industrial applications including rock drilling and metal machining for many years. One of the factors limiting the success of PDC is the strength of the bond between the polycrystalline diamond layer and the sintered metal carbide substrate. For example, analyses of the failure mode for drill bits used for deep hole rock drilling show that in approximately 33 percent of the cases, bit failure or wear is caused by delamination of the diamond from the metal carbide substrate.

U.S. Pat. No. 3,745,623 (reissue U.S. Pat. No. 32,380) teaches the attachment of diamond to tungsten carbide support material with an abrupt transition therebetween. This, however, results in a cutting tool with a relatively low impact resistance. Due to the differences in the thermal expansion of diamond in the PDC layer and the binder metal used to cement the metal carbide substrate, there exists a shear stress in excess of 200,000 psi between these two layers. The force exerted by this stress must be overcome by the extremely thin layer of cobalt which is the common or preferred binding medium that holds the PDC layer to the metal carbide substrate. Because of the very high stress between the two layers which have a flat and relatively narrow transition zone, it is relatively easy for the compact to delaminate in this area upon impact. Additionally, it has been known that delamination can also occur on heating or other disturbances in addition to impact. In fact, parts have delaminated without any known provocation, most probably as a result of a defect within the interface or body of the PDC which initiates a crack and results in catastrophic failure.

One solution to this problem is proposed in the teaching of U.S. Pat. No. 4,604,106. This patent utilizes one or more transitional layers incorporating powdered mixtures with various percentages of diamond, tungsten carbide, and cobalt to distribute the stress caused by the difference in thermal expansion over a larger area. A problem with this solution is that "sweep through" of the metallic catalyst sintering agent is impeded by the free cobalt and the cobalt cemented carbide in the mixture.

U.S. Pat. No. 4,784,023 teaches the grooving of polycrystalline diamond substrates. This patent specifically mentions-the use of undercut (or dovetail) portions of substrate ridges, which solution actually contributes to increased localized stress. Instead of reducing the stress between the polycrystalline diamond layer and the metallic substrate, this actually makes the situation much worse. This is because the larger volume of metal at the top of the ridge will expand and contract during heating cycles to a greater extent than the polycrystalline diamond, forcing the composite to fracture at the interface. As a result, construction of a polycrystalline diamond cutter following the teachings provided by U.S. Pat. No. 4,784,023 is not suitable for cutting applications where repeated high impact forces are encountered, such as in percussive drilling, nor in applications where extreme thermal shock is a consideration.

U.S. Pat. No. 4,592,433 teaches grooving substrates but it does not have a solid diamond table across the entire top surface of the substrate. While this configuration is not subject to delamination, it cannot compete in harsh abrasive applications.

U.S. Pat. No. 5,011,515 teaches the use of a sintered metal carbide substrate with surface irregularities spread relatively uniformly across its surface. The three dimensional irregularities can be patterned or random to control the percentage of diamond in the zone that exists between the metal carbide support and the polycrystalline diamond layer. This zone can be of varying thickness.

U.S. Pat. No. 4,109,737 teaches the use of a pin with a reduced diameter hemispherical projection over which a diamond layer is directly bonded in the form of a hemispherical cap. The polycrystalline diamond layer receives greater support from the hemispherical shape to make the surface more resistant to impact.

SUMMARY OF THE INVENTION

This discloses several cutting elements for use in drill bits for rock drilling, and other operations which require the high abrasion resistance or wear resistance of a diamond surface, and the devices comprise a cemented metal carbide stud, preferably tungsten carbide, having a reduced shaped outer end surface. A layer of polycrystalline material is disposed over the outer end portion of the cemented metal carbide stud to form a cap.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may add to other equally effective embodiments.

FIG. 1 is a side view of a conically shaped round insert having a PDC layer on it;

FIG. 2 is a plan view of the insert of FIG. 1;

FIG. 3 is a sectional view taken along the line 3—3 in FIG. 2 showing the PDC layer on the crown of the insert;

FIG. 4 is a side view of a similar insert to that shown in FIG. 1;

FIG. 5 is a plan view of the insert in FIG. 4;

FIG. 6 is a sectional view taken along the line 6—6 of FIG. 5 showing the PDC layer on the insert;

FIG. 7 is a side view of a chisel insert;

FIG. 8 is a plan view of the insert of FIG. 7;

FIG. 9 is a sectional view taken along the line 9—9 of FIG. 8 showing the PDC layer thereon;

FIG. 10 is a side view of a chisel insert;

FIG. 11 is a plan view of the insert shown in FIG. 10;

FIG. 12 is a sectional view of the insert of FIG. 11 taken along the line 12—12 showing details of the PDC layer on the insert;

FIG. 13 is a side view of another insert;

FIG. 14 is a plan view of the insert of FIG. 13;

FIG. 15 is a sectional view taken along the line 15—15 of FIG. 14 further showing a PDC layer on the insert;

DETAILED DESCRIPTION OF THE PREFERRED EMBODIMENTS

Figure 17:
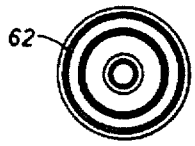
FIGS. 17, 19, 21, 23, 25 and 27 are plan views of the inserts in the adjacent drawings showing the end of the insert incorporating different contours to assure that the PDC layer is held firmly in place.
Figure 19:
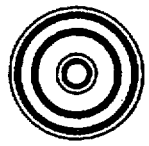

Attention is first directed to FIG. 1 of the drawings where the numeral 10 identifies the insert illustrated in FIGS. 1, 2 and 3. This insert utilizes a metal carbide stud body 11 which is typically constructed of tungsten carbide (WC).

The insert body is an elongate cylindrical member and has an exposed tip portion which performs the cutting requirements. The tip is shaped as a cone 12 and is rounded at the tip portion 13. This rounded portion has a diameter which is approximately 35–60% of the diameter of the insert. This defines a curved hemispheric region at the tip 13. The insert 10 is also shown in FIG. 3 of the drawings where the conic area 12 slopes to the central point. The central point is, while not sharp, defined by the hemispheric portion having the diameter just mentioned. The outer tip end is coated with PDC material 14. The coating covers the hemispheric portion 13 and extends down the sides of the conic region 12. The PDC layer shields the WC stud from abrasive destruction during use.

By contrast, the embodiment 20 shown in FIG. 4 is somewhat different. It has a similar tungsten carbide body 21 which is provided with a conic tip 22. The tip is shaped with a hemispheric region 23. In this particular instance, the diameter of the hemispheric tip region at the end of the cone 22 is much smaller than the embodiment 10 shown in FIG. 1. There, the diameter can be as much as about 60% of the diameter of the insert. In this instance, the hemispheric tip 23 has a diameter that is about 15% or less. It is not necessary to make the tip pointed and hence the minimum diameter is about 5%. Accordingly, the range for the diameter of this region is between about 5 and 20% of the diameter of the insert. As before, it is provided with a PDC layer 24. This layer provides similar protection to that of the layer 14 shown in FIG. 3 of the drawings.

CHISEL INSERTS

Going now to FIG. 7 of the drawings, the numeral 30 identifies a chisel insert. It has a body 31 which is formed of a similar WC material typically as noted before. The WC particles are compressed in an insert construction supported in a matrix. This provides a very hard cutting insert. In this particular instance, the insert is provided with a sloping back face 32. This back face is also shown in FIG. 9 of the drawings. In addition to that, there is a sloping front face 33. The front face connects with an edge 34 which is also shown in the plan view of FIG. 8. Referring to FIGS. 7, 8 and 9 collectively, a plane 36 is formed which contains the edge 34 and which is parallel to the longitudinal or "lengthwise" axis of the body 31. The plane 36 is represented by the surface of FIG. 7. So to speak, a sharp edge is provided in the insert construction of the embodiment 30. The entire cutting edge 34 and both of the right faces 32 and the left face 33 are covered with the PDC material 35.

Of similar construction, FIG. 10 shows another chisel embodiment at 40. The chisel 40 is constructed with the insert body 41 which is formed of the WC particles in the supportive matrix. This construction utilizes a back face 42 and a symmetrical front face 43 which converge to form an edge 44. Referring collectively to FIGS. 10, 11 and 12, the edge 44 is contained in a plane 46 which also contains the longitudinal or "lengthwise" axis 48 of the body 41. The plane 46 is represented by the surface of FIG. 10. As shown in the sectional view of FIG. 12, the left face 43 and the right face 42 are at a common angle measured relative to the plane 36, while the faces 32 and 33 in FIG. 9 are not at the same angle measured relative to the plane 46. This defines the edge 44 which transects the circular insert 40. It is not an edge in the sense that a knife has an edge; it is an edge in the same sense as a chisel. It is an edge which is exposed for cutting, and so that the edge will have substantial life, the PDC layer 45 is placed over the edge 44 and both the faces 42 and 43.

FLAT INSERT CONSTRUCTION

The numeral 50 refers to a flat insert. This insert incorporates an insert body 51 formed of WC material to serve as a very hard structure. The tip of the insert is a conic portion 52. The tip is flattened at a central portion 53. This defines a circular shoulder 54 better shown in FIG. 14. PDC material 55 is placed over the end of the insert. This particular embodiment is constructed with a conic portion similar to the embodiments 10 and 20 previously mentioned. The conic aspect is terminated differently in the embodiment 50 by the flat face.

Consider now the differences in the embodiment 10, 20, 30, 40 50. The embodiments 10, 20 and 50 have conic portions which are covered with the PDC material. The conic tips 12 and 22 terminate at the hemispheric regions 13 and 23. They are similar except for the difference in the tip diameter. By contrast, the embodiment 50 is constructed with a flat face.

The two chisels 30 and 40 are somewhat different. They are provided with front and back faces. They also define cutting edges 34 and 44 in the two embodiments. These edges have approximately the same length. There is a tendency however to have different wear rates depending on the types of materials being drilled by the two different inserts 30 and 40.

One significant advantage of the embodiments described above is that the hemispherical projection in embodiments 10 and 20 reduces the amount of shear stress applied to the polycrystalline layers 14 and 24. As a matter of geometry, the hemispherical shape of the projection will tend to experience forces which are normal to the surface of the polycrystalline surface rather than forces which shear across its face. Without the hemispherical protrusion, the planar layer interface between the joined materials will be subjected to shear forces tending to break off the outer PDC tip. The break line is at the interface between the joined dissimilar materials. For example, as a drill bit rotates about its axis, the hemispherical projection will cut against the working face of the rock with a shattering impact of substantial shock. The apex or outermost portion of the cutting element will continue to experience impact loading forces during drilling. In this invention, the hemispherical projection helps to prevent delamination of the polycrystalline layer from the metal carbide stud.

Another second advantage arises from the stepwise transition of materials which reduces the amount of shear stress on the bond between the layer of polycrystalline material and the metal carbide stud. When the polycrystalline layer is bonded face to face with the smooth surface of a metal carbide stud, the overall strength of the cutting element is determined primarily by the strength of the bond. However, the bond is ordinarily much weaker and will withstand less shear stress than either the polycrystalline layer or the metal carbide stud. Therefore, the present invention includes a curving conic surface enabling joinder between the metal carbide stud and the polycrystalline layer. The conic surface functions in a manner to transfer normal stresses from the polycrystalline layer to the metal carbide stud without placing the full stress on the bond. As a result, the cutting element can withstand normal forces which are significantly greater than that which the bonding material alone can sustain.

INSERT END FACE CONSTRUCTION

Before going over specific aspects of FIGS. 16–27 inclusive, it should be noted that the insert is modified at its interface with the PDC layer on the end face so that the PDC layer is less likely to break off the insert and be lost during use. More specifically, the several inserts which are shown in FIGS. 16–27 have surface mechanisms enabling the inserts to be held or grasped for longer life in the drill bit. Perhaps this will become more readily apparent on a discussion of and consideration of the insert shown in FIGS. 16 and 17 jointly.

Figure 16:
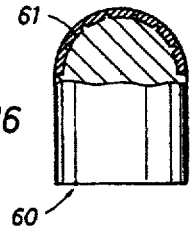
FIGS. 16, 18, 20, 22, 24 and 26 show in sectional view alternate forms of the PDC layer further incorporating specially modified surfaces for assuring that the PDC layer attaches to the insert.
Figure 18:
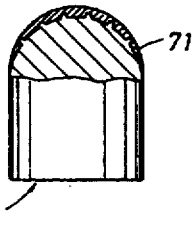
Figure 21:
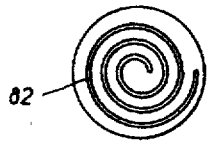
Figure 23:
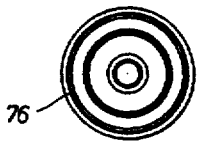

Going now to FIG. 16 of the drawings, the numeral 60 identifies an insert which is constructed with a hemispheric end face. The end face 61 is constructed with a set of protruding concentric rings 62. The embodiment 60 serves the purpose of showing how the PDC which is placed on the embodiments 10, 20, 30, 40 and 50 can be held in place. The embodiment 60 thus is intended to show one method of attachment for the PDC layer and in particular the PDC layers 14 and 24 which are attached to the embodiments 10 and 20 respectively. In particular, this mode of attachment is helpful so that the PDC layer is held firmly in place and does not break, flake, or otherwise separate from the underlying insert. As will be understood, the mode of attachment shown in the embodiments 60 can likewise be incorporated in the embodiment 30 taking into account that there are planar faces involved in that construction. Similar rings can be placed around the insert so that the rings 62 can be incorporated in the embodiment 50.

Going next to the embodiment 70, it is similar to the embodiment 60 in all aspects except that the PDC layer is thinner around the periphery in the region 71. Thinning the PDC layer shortens the life on the one hand but also tends to reduce the tendency toward breaking or otherwise separating. Moreover, the bulk of the wear is located near the most remote tip of the insert. Thus, the grip which is achieved between the PDC layer in the embodiments 60 or 70 can be used to advantage in the various embodiments 10, 20, 30, 40 or 50.

Figure 22:
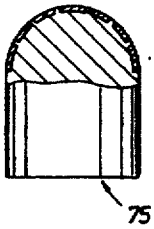
Figure 25:
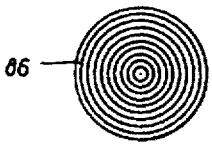
Figure 27:
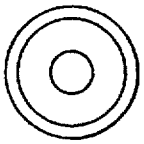

In FIG. 22, another embodiment 75 is illustrated and is similar to the embodiments 60 and 70. It is different in that the rings 76 extend to the surface. These rings are formed flush with the end of the PDC layer over the domed shape insert. As before, this particular embodiment can be used to assure that the PDC layer is held firmly in place. If a crack or fissure is formed it will not propagate through the rings. The embodiment 75 thus can be used to advantage to hold the PDC layer in place in the embodiments 10 or 20 previously mentioned. Likewise, this arrangement can be used with the embodiment 50 to great advantage.

Figure 20:
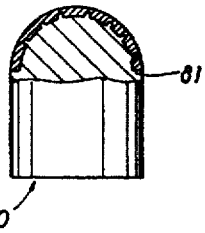

The embodiment 80 shown in FIG. 20 is similar to the embodiment 60. That is, there is a step or shoulder 81 providing a definitive thickness of PDC layer. In this instance, the insert is not equipped with a set of rings. Further, a single ring which is extended through about two and up to four revolutions is included and is identified by the numeral 82. This spiral shaped ring construction serves the same purpose for fixing the PDC layer on the structure. The embodiments 60, 70, 75 and 80 all can be used in similar fashion to anchor the PDC layer on inserts such as those illustrated at 10, 20 or 50.

Figure 24:
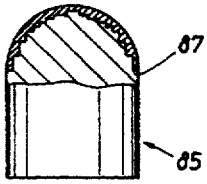
Figure 26:
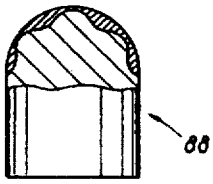

In FIG. 24 of the drawings, an alternate embodiment 85 is illustrated. Rather than rings, the insert is equipped with a number of steps 86. Beginning at an edge defining shoulder 87, the PDC layer is placed over the steps 86 and covers completely to the shoulder. Easier machining is typically available in fabrication of the embodiment 90 shown in FIG. 26. This has steps which are not so sharply defined; rather they are formed as gentle undulations. Specific manufacturing steps do not need to be implemented to make this; it can normally be formed at the time of fabrication of the inserts; it provides an enhanced gripping surface with the PDC layer. As before, the embodiment 85 can be used as desired with any of the embodiments 10–50 previously mentioned. The same is true of the gripping surface in the embodiment 90. To summarize, the several embodiments, 60, 70, 75, 80, 85 and 90 are constructed as a means and mechanism for holding the PDC layer on the insert.

It will be understood that certain combinations and subcombinations of the invention are of utility and may be employed without reference to other features in subcombinations. This is contemplated by and is within the scope of the present invention. As many possible embodiments may be made of this invention without departing from the spirit and scope thereof, it is to be understood that all matters hereinabove set forth or shown in the accompanying drawing are to be interpreted as illustrative and not in a limiting sense.

While the foregoing is directed to the preferred embodiments, the scope thereof is determined by the claims which follow:

I claim:

1. A cutting element comprising:

(a) a metal carbide stud having an outer end having a transverse transecting edge portion at the remote outer end thereof;

(b) left and right opposing tapered faces formed next to said edge portion wherein each of said faces has a substantially planar surface area extending from said edge and wherein said faces are the left face and the right face and said faces intersect to define said transecting edge portion; and (c) a layer of polycrystalline material disposed directly over said face portion of said metal carbide stud, wherein said face has mechanisms which enhance the adhesion of said polycrystalline material to said face, and wherein said polycrystalline material comprising particles selected from diamond, cubic boron nitride, wurtzite boron nitride, and mixtures thereof bonded together in a unitary relationship.

2. The cutting insert of claim 1 wherein said left and right faces define equal and opposite angles with respect to a plane through said edge and parallel to an axis lengthwise of said stud and said faces are symmetrical on the left and right of said transecting edge.

3. The apparatus of claim 1 wherein:

(a) said stud is cylindrical;

(b) said transecting edge is not a diameter of said cylindrical stud; and (c) said left and right faces are positioned at different angles with respect to a plane through said edge and parallel to an axis lengthwise of said stud.

4. The apparatus of claim 1 wherein:

(a) said stud in cylindrical;

(b) said transecting edge is not a diameter of said cylindrical stud; and (c) said left and right faces intersect said outer transecting edge at different heights with respect to said edge portion.

* * * * *

UNITED STATES PATENT AND TRADEMARK OFFICE

CERTIFICATE OF CORRECTION

PATENT NO. : 5,630,479
DATED : May 20, 1997
INVENTOR(S) : Mahlon D. Dennis

It is certified that error appears in the above-identified patent and that said Letters Patent is hereby corrected as shown below:

On the title page, right column, change "1 Drawing Sheet" to --2 Drawing Sheets--.

IN THE DRAWINGS

Add the Drawing Sheet consisting of FIGS. 16-27, as shown on the attached page.

Signed and Sealed this

Thirtieth Day of September, 1997

*Attest:*

*Attesting Officer*

Bruce Lehman

BRUCE LEHMAN

*Commissioner of Patents and Trademarks*